US011820477B2

(12) United States Patent
Taylor, Jr. et al.

(10) Patent No.: US 11,820,477 B2
(45) Date of Patent: Nov. 21, 2023

(54) CONTOURED BOAT PROPELLER SHIELD

(71) Applicants: Guy Taylor, Jr., Duchesne, UT (US); Aaron Browning, Tolleson, AZ (US)

(72) Inventors: Guy Taylor, Jr., Duchesne, UT (US); Aaron Browning, Tolleson, AZ (US)

( * ) Notice: Subject to any disclaimer, the term of this patent is extended or adjusted under 35 U.S.C. 154(b) by 181 days.

(21) Appl. No.: 17/200,188

(22) Filed: Mar. 12, 2021

(65) Prior Publication Data

US 2021/0284306 A1 Sep. 16, 2021

Related U.S. Application Data

(60) Provisional application No. 62/988,818, filed on Mar. 12, 2020.

(51) Int. Cl.
*B63H 1/18* (2006.01)

(52) U.S. Cl.
CPC ..... *B63H 1/18* (2013.01)

(58) Field of Classification Search
CPC . B63H 1/18; B63H 20/00; B63H 5/16; B63H 5/165
See application file for complete search history.

(56) References Cited

U.S. PATENT DOCUMENTS 4,070,984 A * 1/1978 Kappas ..... B63H 5/165 440/72
6,159,062 A * 12/2000 Taylor, Jr. ..... B63H 5/16 440/71
6,397,772 B1 * 6/2002 Christensen ..... B63H 25/44 114/145 A
8,257,121 B2 * 9/2012 Taylor ..... B63H 5/165 440/71

FOREIGN PATENT DOCUMENTS

JP 3306089 B2 * 7/2002 ..... B63H 5/16

* cited by examiner

*Primary Examiner* — Anthony D Wiest
(74) *Attorney, Agent, or Firm* — KIRTON McCONKIE; Evan R. Witt

(57) ABSTRACT

A propeller shield to selectively shield rotating blades of a propeller. The propeller shield may include a shield element for placement adjacent to the propeller blades. The shield element may include multiple gates configured to open in response to water flow generated by the propeller. The gates may be configured to open away from the propeller in response to a forward movement of the boat, and to close towards the propeller in response to cessation of the forward movement.

12 Claims, 4 Drawing Sheets

CONTOURED BOAT PROPELLER SHIELD

CROSS-REFERENCE TO RELATED APPLICATION

This application claims the benefit of U.S. Application No. 62/988,818, filed Mar. 12, 2020, entitled CONTOURED BOAT PROPELLER SHIELD.

BACKGROUND OF THE INVENTION

1. Field of the Invention

The present invention relates generally to a shield for shielding the blades of a propeller.

2. Background and Related Art

Propeller blades rotate at high speeds to create the forces that move a boat or watercraft forward through the water. The rotational motion of the blades is converted into thrust by creating a pressure difference between the two surfaces. The propeller thus generates a flow of water in a backward direction to propel the boat forward. As a result, propeller performance depends on water flow through the propeller. Anything that tends to block or direct water away from the propeller may adversely impact propeller performance.

Propellers, however, are also dangerous and prone to damage due to their usual position below the bottom surface of the boat. Should a passenger, skier, swimmer or other person be accidentally hit by the propeller during operation of the motor, serious injury will inevitably result. The propeller also tends to be very susceptible to damage from underwater objects such as rocks, sandbars, marine life and the like. If the propeller becomes damaged, it may become unable to perform as designed. Repair and/or replacement of a damaged propeller tends to be inconvenient as well as expensive.

BRIEF SUMMARY OF THE INVENTION

The present application relates generally to a propeller shield to shield blades of a propeller during use. The propeller shield may guard an outboard motor propeller to prevent contact with underwater objects. In some embodiments, the propeller shield may include multiple gates that automatically open when a boat is moving forward and close when the boat is idle or moving in a reverse direction. Embodiments of a propeller shield as disclosed herein may thus prevent damage to the propeller as well as damage inflicted by the propeller on surrounding people or objects. Embodiments may also minimize adverse boat performance that may otherwise result from impeded water flow. Some embodiments of a propeller shield may improve control characteristics such as planing, top speed, acceleration and steering.

In some embodiments, a propeller shield to selectively shield blades of a propeller may include a shield element for placement adjacent to blades of a propeller. The shield element may include multiple gates configured to open in response to water flow generated by the propeller. The gates may be configured to open away from the propeller in response to a forward movement of the boat.

In some embodiments, each of the gates may be further configured to close towards the propeller in response to cessation of the forward movement, such as the boat being idle or moving in a reverse direction. In some embodiments, a biasing element such as a spring-loaded hinge may be coupled to each of the gates to automatically close the gate in response to cessation of the forward movement.

In some embodiments, each of the gates may include an interior edge. The gates may be configured such that an interior edge of a first gate may substantially align with an interior edge of a second gate in response to cessation of the forward movement.

The propeller may be configured to rotate about an axis. In some embodiments, the shield element may be configured for placement transverse to the axis. In some embodiments, the shield element may include a substantially convex contour. This contour may form a reservoir between the propeller and the shield element to provide increased water flow in response to a reverse movement of the boat. In some embodiments, the shield element may include a substantially flat contour.

In some embodiments, the shield element may include multiple apertures formed in the gates to enable water to flow therethrough. In these and other embodiments, the water flow generated by the propeller may exert a force on a portion of the shield element surrounding the apertures to open the gates.

In some embodiments, the shield element may be coupled to a guard element. The guard element may be configured for placement adjacent to tips of the blades and circumscribing a periphery of the propeller.

The above and other objects and advantages of the present invention are realized in illustrated embodiments thereof, shown and described by way of example and not by way of limitation, and the following detailed description of the invention and the drawings, in which similar structure is identified with similar numbers throughout

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

The disclosed propeller shield is an alternative configuration of the propeller shield disclosed in U.S. Pat. No. 8,257,121, which patent is incorporated herein by reference. The disclosed propeller shield may be used with any suitable propeller guard that covers the propeller's lateral-most edges. One particularly effective propeller guard is disclosed in U.S. Pat. No. 6,159,062, which patent is incorporated herein by reference.

Referring now to FIGS. 1A-3B, the present application relates generally to a propeller shield 100 to shield blades of a boat propeller during use. In some embodiments, the propeller shield 100 may include one or more gates 104*a*, 104*b* that automatically open when the boat is moving forward and automatically close when the boat is idle or moving in a reverse direction. Embodiments of a propeller shield 100 as disclosed herein may thus prevent damage to the propeller as well as damage inflicted by the propeller on surrounding people or objects.

Some known propeller guards may completely inhibit a flow of water directly into the propeller during a turn, thereby causing cavitation in the area of the propeller. This cavitation may cause a loss of thrust of the motor, which in turn may cause a loss of steering control. Embodiments of a propeller shield 100 in accordance with the present invention may minimize boat performance drops and other issues that may otherwise result from impeded water flow to the propeller. Some embodiments of a propeller shield 100 may also improve boat control characteristics such as planing, top speed, acceleration, and steering.

In some embodiments, a propeller shield 100 to selectively shield blades of a propeller in accordance with embodiments of the invention may include a shield element 102 for placement adjacent to blades of a propeller. In some embodiments, the shield element 102 may be formed of aluminum, stainless steel, or other suitable metals or metal alloys. In other embodiments, the shield element 102 may include materials such as plastics, woods, carbon fiber, or any other suitable material or composite material known to those in the art.

Figure 2B:
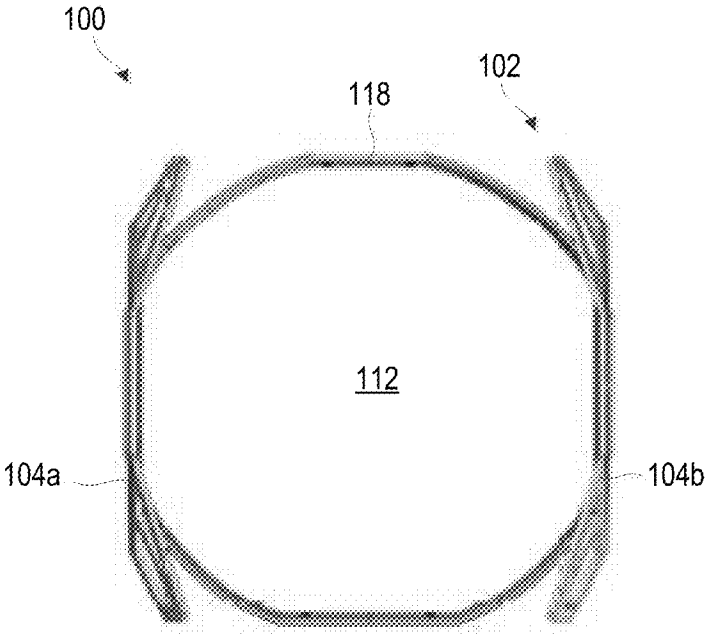
FIG. 2B is a front view of the shield element and guard element of FIG. 2A.
Figure 2A:
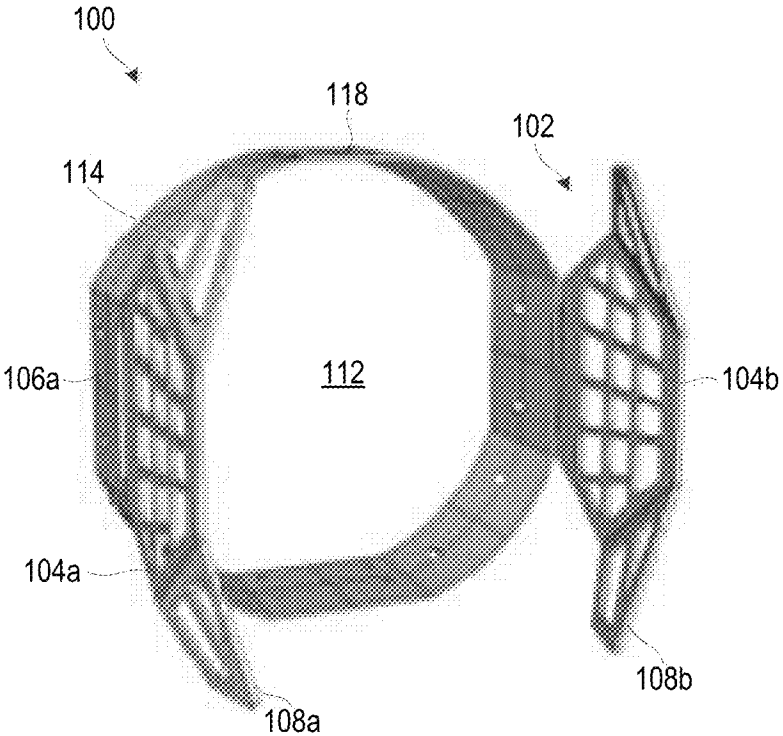
FIG. 2A is a perspective view of a shield element coupled to a guard element, illustrating gates in an open position when the boat is moving in a forward direction in accordance with some embodiments.

In some embodiments, as shown in FIGS. 2A and 2B, the shield element 102 may include one or more gates 104*a*, 104*b* configured to open in response to water flow generated by the propeller. In some embodiments, the gates 104*a*, 104*b* may be configured to open away from the propeller in response to a forward movement of the boat.

Figure 1B:
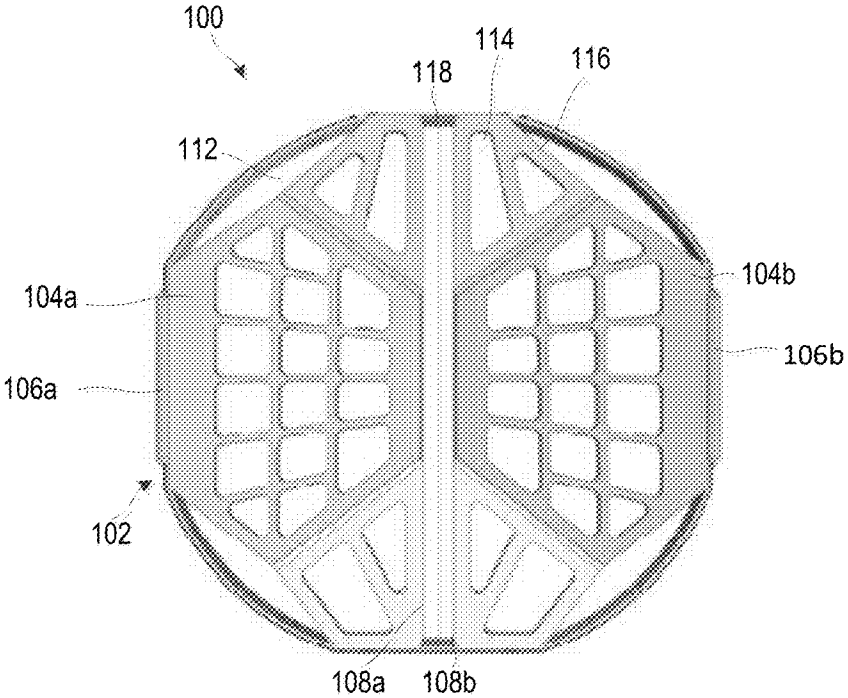
FIG. 1B is a front view of the shield element and guard element of FIG. 1A.
Figure 1A:
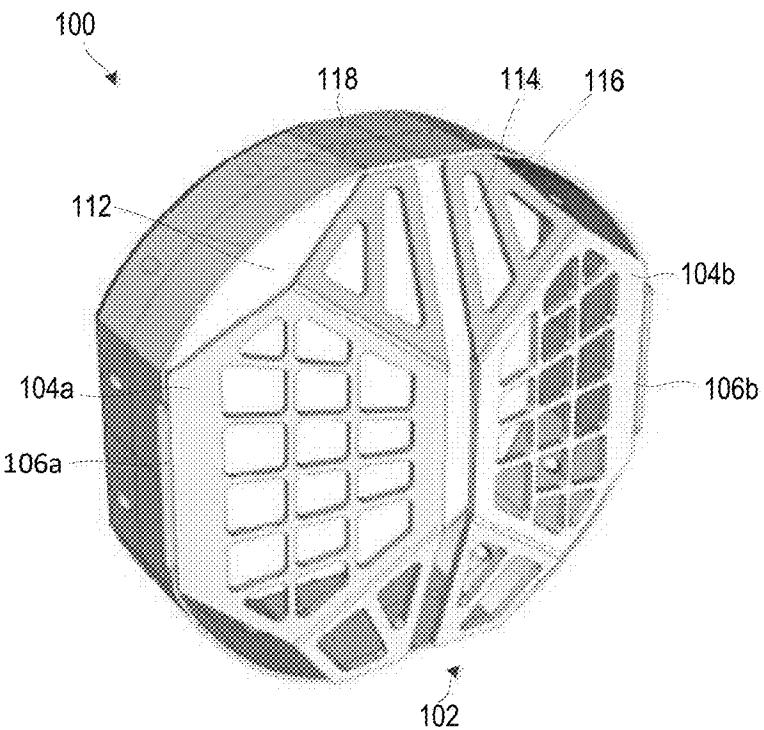
FIG. 1A is a perspective view of a shield element coupled to a guard element, illustrating gates in a closed position in accordance with some embodiments.

As shown in FIGS. 1A and 1B, in some embodiments, each of the gates 104*a*, 104*b* may be further configured to close towards the propeller in response to cessation of the forward movement, such as the boat being idle or moving in a reverse direction. In this manner, the gates 104*a*, 104*b* may prevent foreign objects from contacting the propeller in either the forward or reverse directions, or when the watercraft is idle.

Figure 3B:
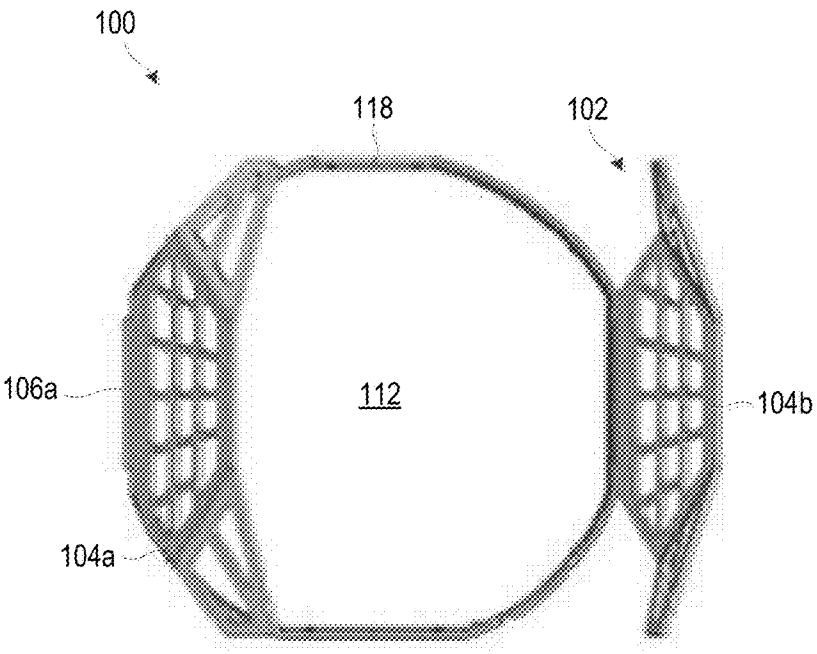
FIG. 3B is a front view of the shield element and guard element of FIG. 3A.
Figure 3A:
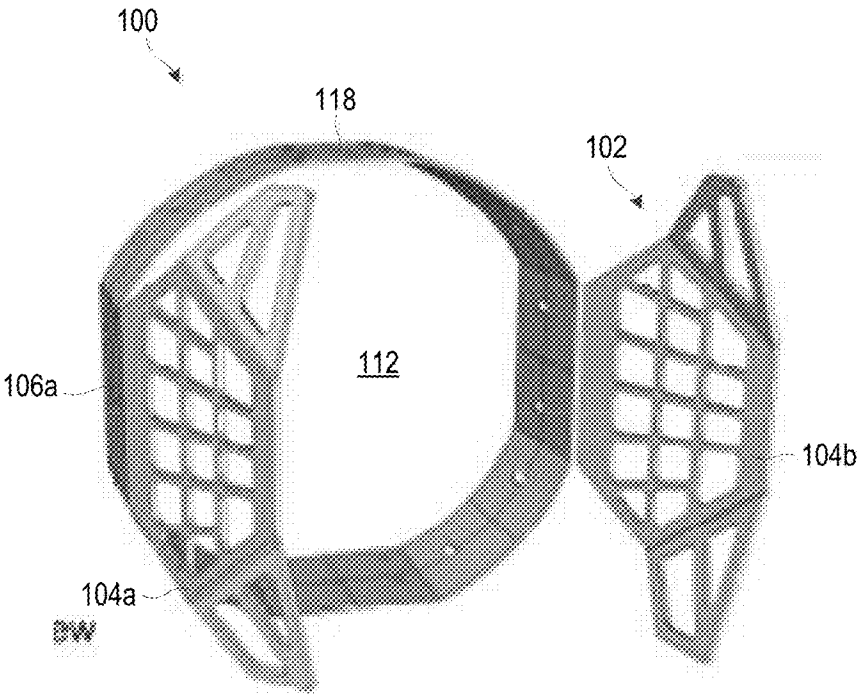
FIG. 3A is a perspective view of a shield element coupled to a guard element, illustrating gates in an open position when the boat is turning in a forward direction in accordance with some embodiments.

In some embodiments, a biasing element 106*a*, 106*b*, such as a hinge or pivot mechanism, may be coupled to each of the gates 104*a*, 104*b* to automatically close the gates 104*a*, 104*b* in response to cessation of the forward movement. In some embodiments, the gates 104*a*, 104*b* may include one or more surface recesses to facilitate attachment of the biasing element 106*a*, 106*b*. In some embodiments, as shown in FIGS. 3A and 3B, the biasing element 106*a*, 106*b* may allow the one or more gates 104*a*, 104*b* to swing or pivot such that resistance to the oncoming water is minimized at all turn radii while the boat is moving in the forward direction.

In some embodiments, the biasing element 106*a*, 106*b* may include a spring, gravity force, or other design known to those in the art to assist the opening and closing of the one or more gates 104*a*, 104*b*. In these and other embodiments, the biasing element 106*a*, 106*b* may be attached to the one or more gates 104*a*, 104*b* using any reliable method, including but not limited to the use of fasteners, welding, brazing, integral design, etc., or any combination thereof. In some embodiments, the biasing element 106*a*, 106*b* may be mounted on an inner surface and/or outer surface of the one or more gates 104*a*, 104*b*.

In some embodiments, the one or more gates 104*a*, 104*b* can be made from any material that has sufficient strength to withstand the forces exerted by fast moving water. The material may also be durable and water resistant. In some embodiments, the one or more gates 104*a*, 104*b* may be flat or curved, including concave and convex, relative to the guard element 118 opening. In one non-limiting embodiment, the one or more gates 104*a*, 104*b* are convex. The thickness and shape of the one or more gates 104*a*, 104*b* may be designed to minimize resistance to water flow in all forward directions and turn radii while maximizing strength to deflect objects in the reverse direction.

In some embodiments, each of the gates 104*a*, 104*b* may include an interior edge 108*a*, 108*b*. The gates 104*a*, 104*b* may be configured such that an interior edge 108*a* of a first gate 104*a* may substantially align with an interior edge 108*b* of a second gate 104*b* in response to cessation of the forward movement.

Figure 4:
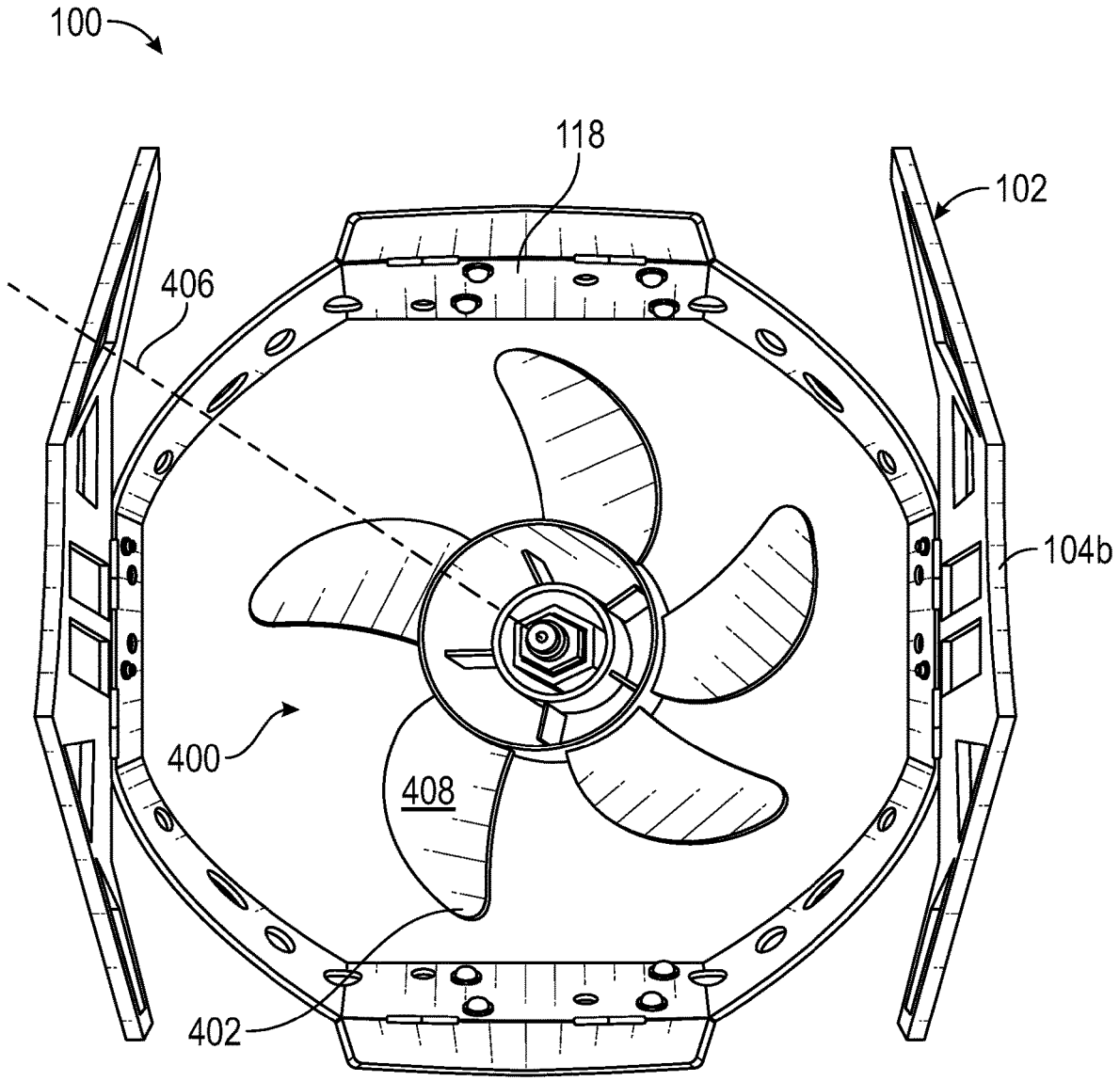
FIG. 4 is a front view of a shield element and guard element installed relative to a propeller in accordance with certain embodiments.

Referring now to FIG. 4, embodiments of a propeller shield 100 as disclosed herein may be adapted for use in connection with motorboats having either an outboard motor or an inboard/outboard motor. In some embodiments, the motor may include a propeller 400 having blades 408 which are operatively connected inside the motor to a conventional-type drive. The guard element 118 may be configured for placement adjacent to tips 402 of the blades 408 and circumscribing a periphery of the propeller. As discussed above, the shield element 102 may guard the propeller 400 to prevent contact with underwater objects.

In some embodiments, the propeller 400 may be configured to rotate about an axis 406. In some embodiments, the shield element 102 may be configured for placement transverse to the axis 406. In some embodiments, the shield element 102 may include a substantially convex contour. This substantially convex contour may form a reservoir 112 between the propeller 400 and the shield element 102 to provide increased water flow in response to a reverse movement of the boat.

In some embodiments, the shield element 102 may include multiple apertures 114 formed in the gates 104*a*, 104*b* to enable water to flow therethrough. In these and other embodiments, the water flow generated by the propeller 400 may exert a force on a portion 116 of the shield element 102 surrounding the apertures 114 to open the gates 104*a*, 104*b*.

In some embodiments, as illustrated in FIG. 4, the shield element 102 may be configured to be coupled to and/or used in conjunction with a guard element 118 that surrounds the lateral-most edges of the propeller 400. In some embodiments, the guard element 118 may be formed from a flat elongated rectangular band of metal formed into a multi-angled shape. In other embodiments, the guard element 118 may be substantially cylindrical, round, hexagonal, octagonal, irregular, or any other suitable shape known to those in the art.

The guard element 118 may be configured for placement adjacent to tips 402 of the blades and circumscribing a periphery of the propeller 400. In some embodiments, the biasing element 106*a*, 106*b* may be mounted on an inner surface and/or an outer surface of the guard element 118. In some embodiments, the guard element 118 may include one or more surface recesses to facilitate attachment of the biasing element 106*a*, 106*b*.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

The invention claimed is:

1. A system to selectively shield blades of a boat propeller, comprising:

a guard element for placement adjacent to and laterally circumscribing tips of blades of the boat propeller;

a shield element comprising a pair of gates attached to the guard element by hinges, the pair of gates configured to open in response to water flow generated by the propeller, the propeller configured to rotate about an axis, wherein the shield element is transverse to the axis, and wherein each of the gates is configured to open away from the propeller in response to a forward movement of the boat; and a biasing element coupled to the guard element and to each of the gates, the biasing element configured to automatically close each of the gates towards the propeller in response to cessation of the forward movement, wherein each of the gates comprises an interior edge, wherein a first interior edge of a first gate is configured to substantially align with a second interior edge of a second gate in response to cessation of the forward movement.

2. The system of claim 1, wherein the biasing element comprises a spring-loaded hinge.

3. The system of claim 1, wherein the shield element comprises a substantially convex contour.

4. The system of claim 3, wherein the substantially convex contour forms a reservoir between the propeller and the shield element to provide increased water flow in response to a reverse movement of the boat.

5. The system of claim 1, wherein the shield element includes a plurality of apertures to enable water to flow therethrough.

6. The system of claim 5, wherein the water flow generated by the propeller exerts a force on a portion of the shield element surrounding the plurality of apertures to open the gates.

7. A method to selectively shield blades of a boat propeller, comprising:

providing a shield element comprising pair of gates configured to open in response to water flow generated by a propeller, wherein the propeller is configured to rotate about an axis, wherein the shield element is adjacent to the blades of the boat propeller and transverse to the axis, and wherein each of the gates is configured to open away from the boat propeller in response to a forward movement of the boat;

positioning a guard element adjacent to tips of blades of the propeller to laterally circumscribe a periphery of the propeller; and coupling each of the gates to the guard element with hinge biasing elements, the biasing elements bias each of the gates against the guard element such that the gates automatically close towards the propeller in response to cessation of the forward movement, and wherein each of the gates comprises an interior edge, wherein a first interior edge of a first gate is configured to substantially align with a second interior edge of a second gate in response to cessation of the forward movement.

8. The method of claim 7, wherein the shield element comprises a plurality of apertures in the shield element to enable a flow of water therethrough.

9. The method of claim 8, wherein the water flow generated by the propeller exerts a force on a portion of the shield element surrounding the plurality of apertures to open the gates.

10. The method of claim 7, wherein the biasing elements comprise spring-loaded hinges.

11. The method of claim 7, wherein the shield element comprises a substantially convex contour.

12. The method of claim 11, wherein the substantially convex contour forms a reservoir between the boat propeller and the shield element to provide increased water flow in response to a reverse movement of the boat.

* * * * *